US008292145B2

(12) United States Patent
Clisset

(10) Patent No.: US 8,292,145 B2
(45) Date of Patent: Oct. 23, 2012

(54) MOUNT AND FEED GUIDE APPARATUS AND METHODS FOR SELECTIVELY DIRECTING A SUPPLY OF MATERIAL TO A FASTENER DRIVER HEAD

(75) Inventor: Steven P. Clisset, Erie, CO (US)

(73) Assignee: Wind Strips, LLC

( * ) Notice: Subject to any disclaimer, the term of this patent is extended or adjusted under 35 U.S.C. 154(b) by 341 days.

(21) Appl. No.: 12/589,781

(22) Filed: Oct. 28, 2009

(65) Prior Publication Data

US 2011/0095065 A1 Apr. 28, 2011

(51) Int. Cl.
*B25C 7/00* (2006.01)

(52) U.S. Cl. ..... 227/136; 227/110; 227/18; 227/119

(58) Field of Classification Search ..... 227/110, 227/18, 119, 136
See application file for complete search history.

(56) References Cited

U.S. PATENT DOCUMENTS 3,664,281 A * 5/1972 Shulman et al. ..... 112/20
3,773,237 A * 11/1973 Cruse ..... 227/18
3,776,159 A * 12/1973 Angele ..... 112/235
3,824,938 A * 7/1974 Tolle ..... 112/70
3,930,297 A * 1/1976 Potucek et al. ..... 29/431
4,152,995 A * 5/1979 Klundt ..... 112/318
6,055,921 A * 5/2000 Olewicz et al. ..... 112/475.07
6,145,725 A * 11/2000 Omli ..... 227/18
6,478,209 B1 11/2002 Bruins et al.
6,736,303 B2 5/2004 Bruins et al.
6,779,700 B2 8/2004 Bruins et al.
7,025,241 B2 4/2006 Castellanos
7,344,058 B2 3/2008 Bruins et al.
2002/0121069 A1 9/2002 Smeja et al.
2003/0057248 A1 3/2003 Bruins et al.
2003/0197046 A1 10/2003 Steed
2004/0155088 A1 8/2004 Smeja et al.

* cited by examiner

*Primary Examiner* — Brian D Nash
(74) *Attorney, Agent, or Firm* — Harold A. Burdick

(57) ABSTRACT

Apparatus and methods are disclosed for selectively orienting material from a coiled supply relative to a fastener driver utilized to secure the material at a work surface. The apparatus includes a mount body having structures adapted to receive and secure the driver and the coiled material supply in a substantially fixed relationship to one another, a material feed orientation arm receiving material fed from the supply and providing the material at an outflow locator adjacent to the drive head of the driver and the work surface when the apparatus is assembled and in use. A pivot stud is affixable to the fastener driver over its drive head and is receivable through openings in the mount body and feed orientation arm so that the outflow locator is pivotable about the drive head to selectively change direction of material feed presentation relative to the drive head.

20 Claims, 8 Drawing Sheets

MOUNT AND FEED GUIDE APPARATUS AND METHODS FOR SELECTIVELY DIRECTING A SUPPLY OF MATERIAL TO A FASTENER DRIVER HEAD

FIELD OF THE INVENTION

This invention relates to fastening tools having feed systems for material to be fastened and, more particularly, relates to such tools having variably orientable components.

BACKGROUND OF THE INVENTION

Systems for securing strip material (often provided in coils or on reels or spools) with a powered fastener driver (stapler, nailer or the like) are commonly utilized in construction and warehouse settings. These systems have proven useful, but are often cumbersome to use and maintain in the field.

To overcome such difficulties, various material feeder and fastener tool combinations have been suggested and/or utilized to allow a worker to more efficiently use such systems (see, for example, U.S. Patent Publication Nos. US2004/0155088, US2002/0121069, US2003/0197046 and US2003/0057248, and U.S. Pat. Nos. 7,025,241, 7,344,058, 6,779,700, 6,736,303, and 6,478,209). These combinations, while incorporating in a single mount the various components (material supply, driver and related fastener cartridges or the like), are also often cumbersome and overly complex to operate, disrupt user sight lines, and frequently distribute tool weight such that the systems are more difficult to operate and/or require supporting wheels or the like.

Moreover, such heretofore known combinations are operable in only a single use configuration so that the direction of strip material application at the work surface relative to fastener driver orientation is always the same thereby effectively limiting the locations in which the strip material can be applied at a particular site. Finally, such combinations frequently are not adaptable for use with off the shelf drivers and material supplies, but instead are almost wholly proprietary. Further improvement of such combinations could thus still be utilized.

SUMMARY OF THE INVENTION

This invention provides a mount and feed guide apparatus and methods for use with a supply of material (coiled for example) and related fastener driver that is light weight, balanced and highly adaptable to work site conditions. The apparatus can be operated singlehandedly and can be adapted on the fly to present the material to be fastened from different directions relative to the faster driver head (up to about 240° of material delivery angle variation, relative to driver head orientation, is accommodated). The apparatus is utilizable with most known fastener drivers and/or material supplies, for example systems employing strip materials for reinforcing, marking, sealing, securing, trimming or the like.

The mount and feed guide apparatus includes a mount body having first and second structures, the first adapted to receive and secure the fastener driver. A third structure, a material feed orientation arm, is pivotably connected at one end thereof with the first structure of the mount body, a material outflow locator provided at the arm's opposite end. The second structure of the mount body includes a material supply carrier positioned to receive the supply of material and provide material to the orientation arm. The orientation arm is configured so that the outflow locator is adjacent to the drive head and the work surface when the apparatus is in use, the outflow locator thus being pivotable about the drive head to selectively change direction of material feed presentation relative to the drive head.

The apparatus is especially well adapted for use with a coiled supply of material and a powered (pneumatic or electric, for example) fastener driver having a drive head and a reloadable fastener supply associated therewith. The mount preferably receives and secures the fastener driver, fastener supply and supply of material to be fastened in a fixed relationship to one another at one side of the apparatus while direction of material feed to the fastener driver head from the orientation arm is variable during use thereof from an opposite side of the apparatus.

In particular, the apparatus is preferably configured with the second structure at one side of the first structure for rotational receipt of a coiled supply of material. A pivot stud is adapted to be affixable to the fastener driver over the drive head thereof and is receivable at the first structure of the mount body, the stud also receivable at the material feed orientation arm at the one end thereof to pivotably locate the orientation arm at an opposite side of the first structure of the mount body from the second structure.

The method of this invention is directed to selectively orienting feed direction from a coiled supply of strip material to a fastener driver head for fastening of the material at a work surface. The coiled supply of material and the driver head are located in a fixed relationship to one another for selected manual movement by a user across the work surface. The material is fed from the supply of material to a material outflow structure pivotable about the driver head, material feed direction at the work surface relative to the driver head established by pivoting the structure. The feed direction is selectively varied as needed by a user during material fastening at the work surface.

It is therefore an object of this invention to provide a mount and feed guide apparatus and methods for use with a supply of material and related fastener driver.

It is another object of this invention to provide a mount and feed guide apparatus for use with a supply of material and related fastener driver that is light weight, balanced and highly adaptable to work site conditions, and that is utilizable with most known fastener drivers and/or material supplies.

It is another object of this invention to provide a mount and feed guide apparatus and methods especially well adapted for use with a coiled supply of material and a powered fastener driver having a drive head and a reloadable fastener supply associated therewith.

It is another object of this invention to provide a mount and feed guide apparatus for use with a supply of material and related fastener driver that can be operated single handedly and can be adapted to present the material to be fastened from different directions relative to the faster driver head.

It is still another object of this invention to provide a mount and feed guide apparatus and methods for use with a supply of material and related fastener driver having a drive head wherein up to about 240° of selectable material delivery angle variation relative to the drive head is accommodated.

It is yet another object of this invention to provide a mount and feed guide apparatus wherein a fastener driver, fastener supply and supply of material to be fastened thereby are mounted and held in a fixed relationship to one another at one side of the apparatus while direction of material feed to the fastener driver head is variably and selectively orientable during use thereof from an opposite side of the apparatus.

It is still another object of this invention to provide a mount and feed guide apparatus and methods that are readily adaptable for use with most systems employing a supply of strip material for reinforcing, marking, sealing, securing, trimming or the like, and utilizing off the shelf staplers and/or nailers.

It is yet another object of this invention to provide a mount and feed guide apparatus adapted for use with a supply of material to be fastened at a work surface and a related fastener driver having a drive head, the apparatus including a mount body adapted to receive and secure the fastener driver thereat, a material feed orientation arm pivotably connected with the mount body at a first end thereof, a material outflow locator provided at a second end thereof, the orientation arm configured so that the outflow locator is adjacent to the drive head and the work surface when the apparatus is in use and is pivotable about the drive head to selectively change direction of material feed presentation relative to the drive head, and a material supply carrier positioned to receive the supply of material and provide material to the orientation arm.

It is still another object of this invention to provide a mount and feed guide apparatus for selectively locating material from a coiled supply at a work surface for fastening thereat utilizing a powered fastener driver having a drive head and a reloadable fastener supply associated therewith, the apparatus including a mount body having a first structure adapted to receive and secure the fastener driver and fastener supply thereat and a second structure at one side of the first structure for rotational receipt of the coiled supply of material, the fastener driver, fastener supply and coiled supply of material thereby mounted and held in a substantially fixed relationship to one another, a pivot stud affixable to the fastener driver over the drive head thereof and receivable at the first structure of the mount body, and a material feed orientation arm receiving the pivot stud at a first end thereof to pivotably locate the orientation arm at an opposite side of the first structure of the mount body from the second structure, a material outflow locator provided at a second end of the orientation arm, the orientation arm configured so that the outflow locator is adjacent to the drive head and the work surface when the apparatus is in use, the outflow locator pivotable about the drive head to selectively change direction of material feed presentation relative to the drive head.

It is yet another object of this invention to provide a method for selectively orienting feed direction from a coiled supply of strip material to a fastener driver head for fastening of the material at a work surface that includes the steps of locating the coiled supply of material and the driver head in a fixed relationship to one another for selected manual movement by a user across the work surface, feeding the material from the supply of material to a material outflow structure pivotable about the driver head, establishing material feed direction at the work surface relative to the driver head by pivoting the structure, and selectively varying the feed direction as needed by a user during material fastening at the work surface.

With these and other objects in view, which will become apparent to one skilled in the art as the description proceeds, this invention resides in the novel construction, combination, and arrangement of parts and methods substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
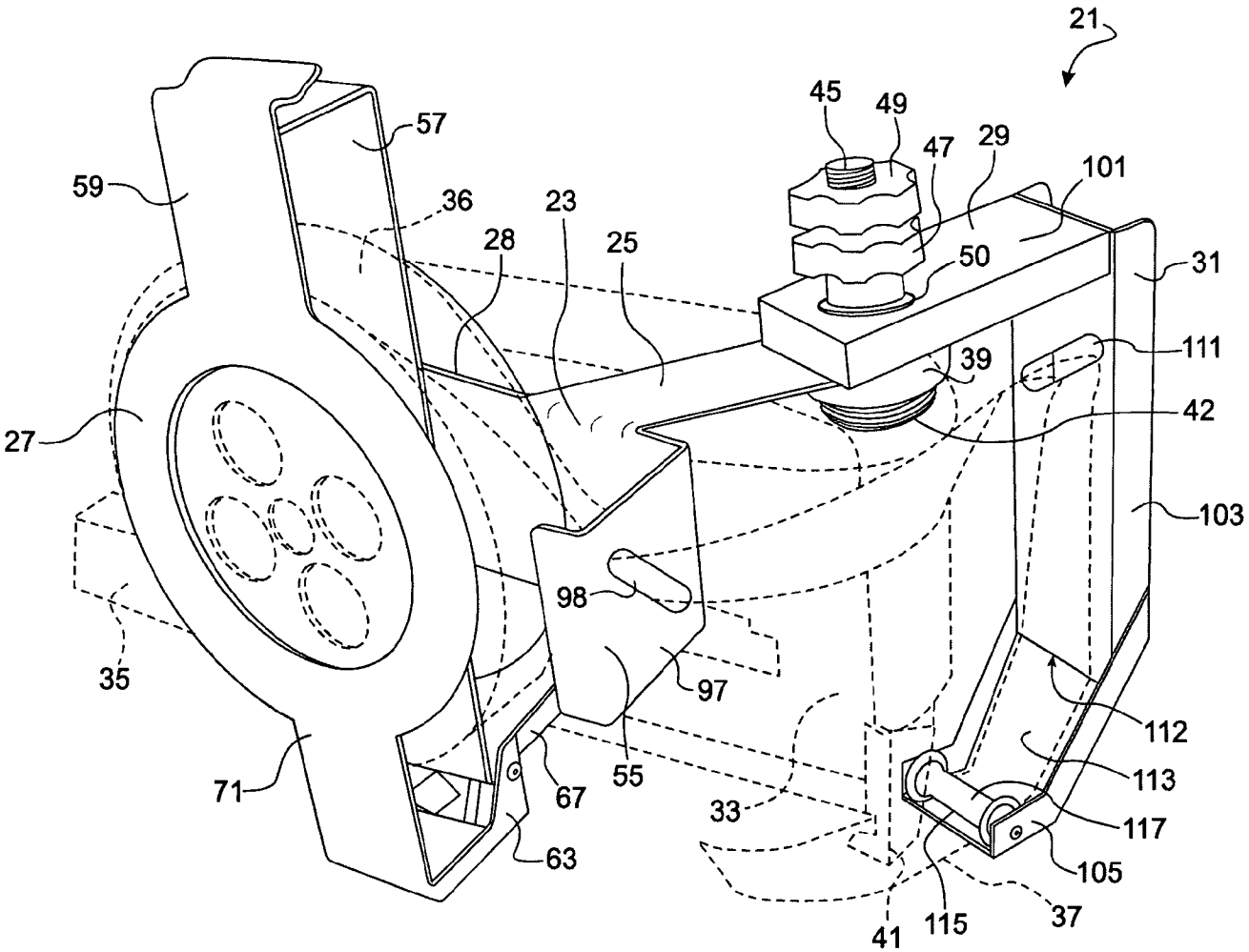
FIG. 1 is a perspective view of a first (and now preferred) embodiment of the mount and feed guide apparatus of this invention.

A first, and now preferred, embodiment of this invention is illustrated in FIGS. 1 through 9. Apparatus 21 includes mount body 23 having first and second mount structures 25 and 27 which share a common mounting wall 28. A third structure 29 pivotably connected with mount body 23 includes material feed orientation arm 31. Structure 25 of mount body 23 is adapted to receive and secure fastener driver 33 and reloadable fastener supply cartridge 35 thereat, while structure 27 is a material supply carrier adapted to receive coiled supply 36 of material 37 to be fastened at a work surface. Orientation arm 31 is pivotably connected with mount body 23 through pivot stud 39 adapted for connection to fastener driver 33 over (and axially inline normal to the work surface) with fastener output drive head 41 of driver 33.

Figure 4:
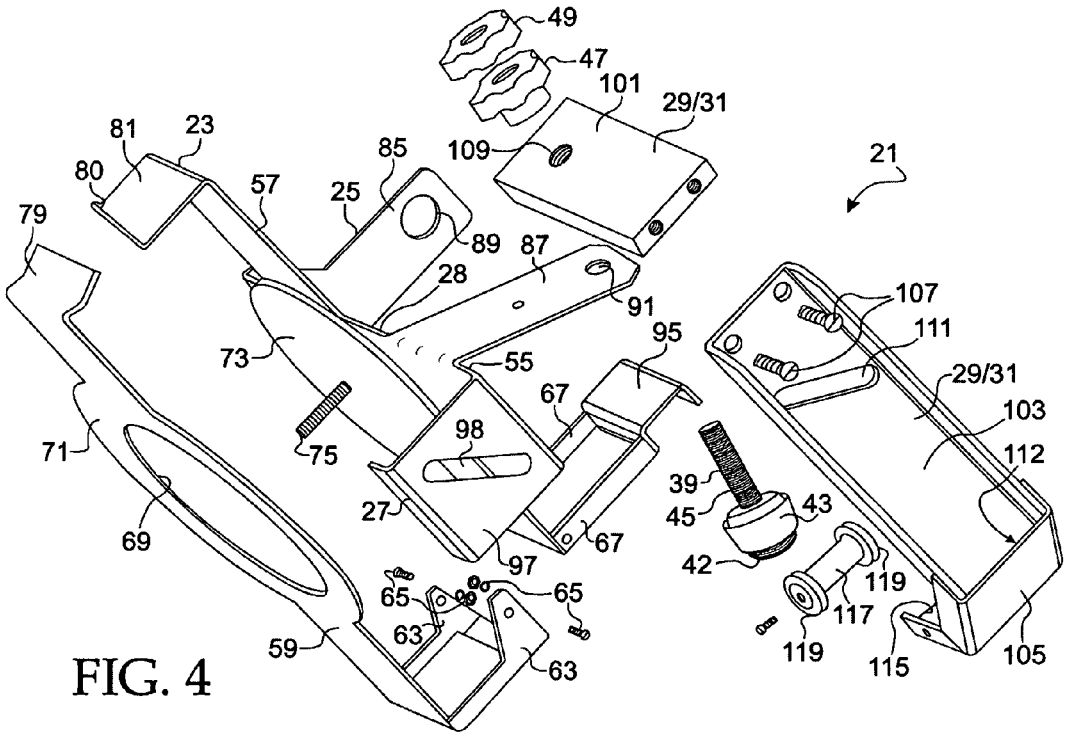
FIG. 4 is an exploded view of the apparatus of FIG. 1.
Figure 5:
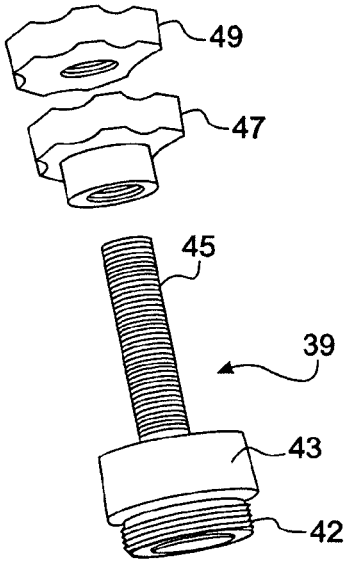
FIG. 5 is a perspective view of one type of pivot stud adapted for use with the apparatus of FIG. 1.
Figure 6:
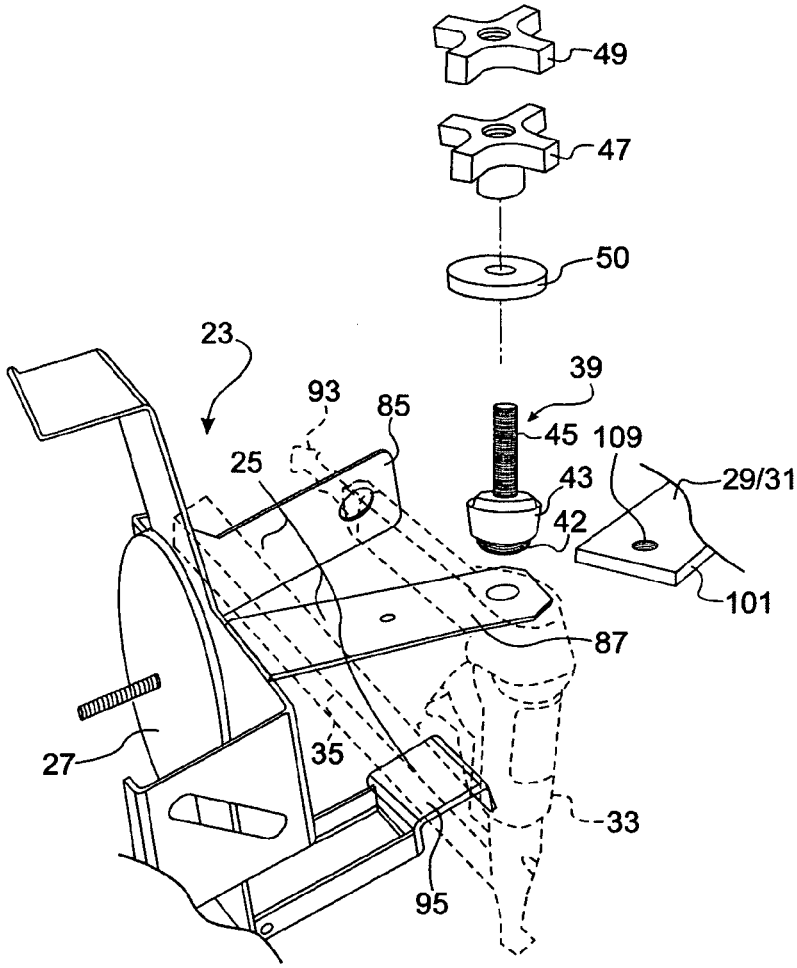
FIGS. 6 through 9 are illustrations depicting use of the apparatus of this invention.

As shown in FIG. 5, stud 39 is specially manufactured for connection to each particular fastener driver type, and thus multiple pivot studs may be supplied with the apparatus adapted for different make and manufacture of drivers. As shown herein in FIGS. 1 through 5, a typical stud 39 replaces the service access cap of a typical staple driver for example, and includes threaded section 42 at stud body 43 matching the driver cap threads which it replaces. A threaded pivot post 45 is engaged by first structure 25 of mount body 23 and structure 29/feed orientation arm 31 as set forth hereinafter in greater detail. Once assembled, arm position is secured by tightening first and second securement knobs 47 and 49, respectively, utilizing nylon washer 50 (shown only in FIGS. 1 and 6). Preferably, a locking nut or knob (nylon, for example) is utilized to set a tightness selected to assure securement of arm position during use while allowing a user to intentionally reposition the arm as may be required given site conditions. The structural assemblage of apparatus 21 shown in FIG. 1 can obtain relative pivotable movement between arm 31 and mount body 23 (and thus relative to driver head 41) through an arc of up to about 240° (between 230° and 250°).

Figure 2:
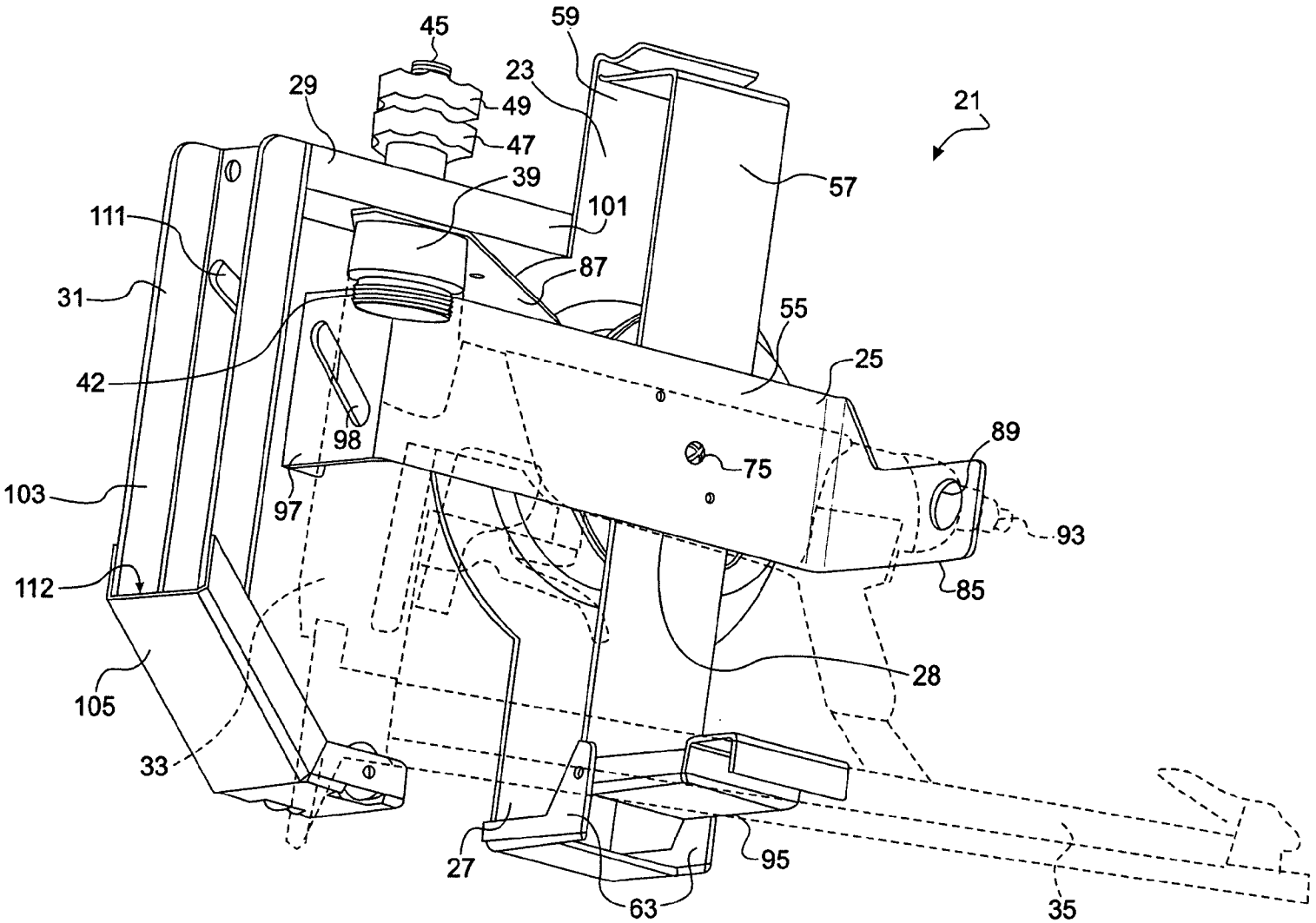
FIG. 2 is another perspective view of the apparatus of FIG. 1.
Figure 3:
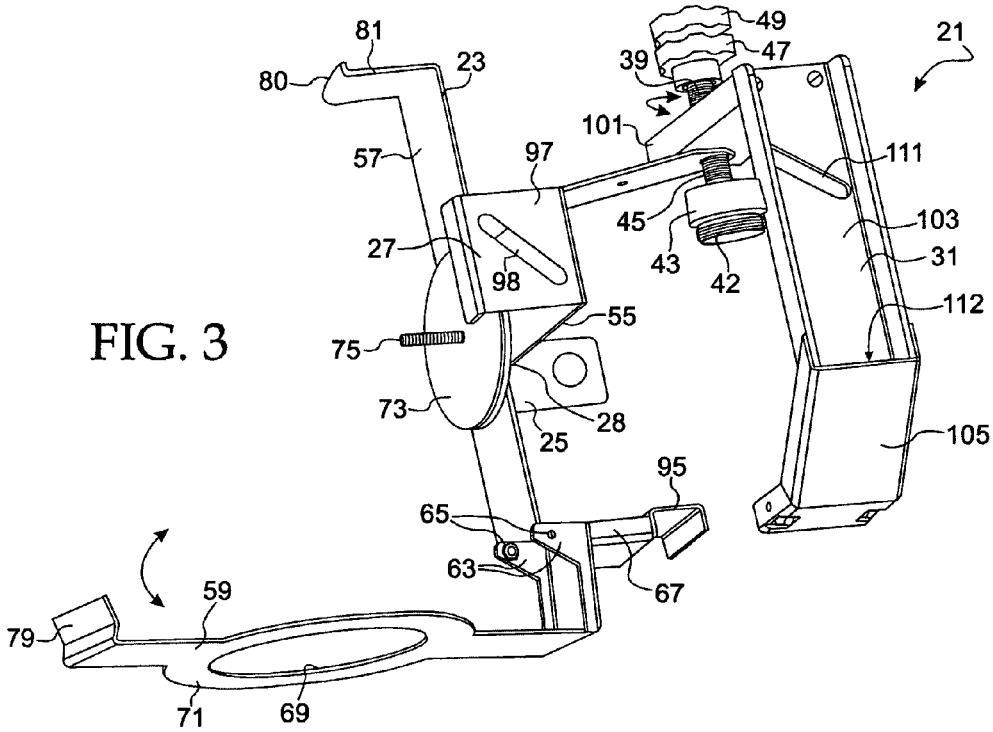
FIG. 3 is a third, partially disassembled, perspective view of the apparatus of FIG. 1.

Structures 25 and 27 of mount body 23 are established by brackets (metal or carbon plastic preferably) 55 and 57 and gate 59, brackets 57 and 59 preferably secured by welding the two brackets at their overlap (see FIG. 2). Turning to FIGS. 3 and 4, coiled supply access and retention gate 59 of structure 27 includes mounting flanges 63 hingedly securable using nuts/screws/washers 65 at mounting flanges 67 of bracket 57. Coiled material supply reel or spool guide/receiver surface 69 is formed at gate face 71. Coiled material reel or spool rotational mounting surface 73 of structure 27 is rotationally retained at brackets 55 and 57 using bolt 75 to accommodate decoiling of the material.

Various known systems of reel or spool mounting are thus accommodated, and could further include various spindle, hub and spindle nut structures to rotationally retain the coiled supply 36 of material 37 at structure 27 depending on the way material 37 is packaged/supplied. Gate 59 includes latching flange 79 engageble at lip 80 of latch flange 81 of bracket 57 for retention of material supply 36 during use and user release to allow reloading by pivoting open gate 59.

Structure 25 includes driver stabilizing flange 85 and pivot mount flange 87 at bracket 55 having mounting openings 89 and 91, respectively, therethrough. Opening 89 is configured to receive air hose coupler 93 of driver 33 therethrough (see FIG. 2), while opening 91 is positioned for receipt of spindle pivot post 45. Mounting channel flange 95 of structure 25 at bracket 57 is fabricated to be received over fastener supply cartridge 35 of driver 33 (see FIG. 2) when apparatus 21 is assembled on driver 33. Material redirecting flange 97 of structure 27 at bracket 55 includes angled (45° preferably) material feed redirecting slot 98. This slot accommodates material feed direction change to orientation arm 31 of structure 29.

Structure 29/arm 31 includes headstock 101 at one end of arm 31, outflow channel 103, and outflow locator 105 at the opposite end of arm 31. Outflow channel 103 is secured to headstock 101 utilizing machine screws 107 in a conventional fashion. Headstock 101 includes pivot stud receiving opening 109 therethrough for receipt of pivot post 45. Channel 103 includes angled (45° preferably) material feed redirecting slot 111 accommodating material feed direction change into channel 103 and locator 105 (through junction slot 112). Outflow locator 105 includes angled guide chute 113 and outflow locator chute 115 for positioning material outflow adjacent to drive head 41 of driver 33 and parallel to the work surface (see FIGS. 1 and 4). Guide roller 117 is rotationally mounted at the end of locator chute 115 (utilizing screws, axles or the like), roller 117 including guide wheels 119 to reduce friction and chatter and further secure smooth material outflow.

Figure 7:
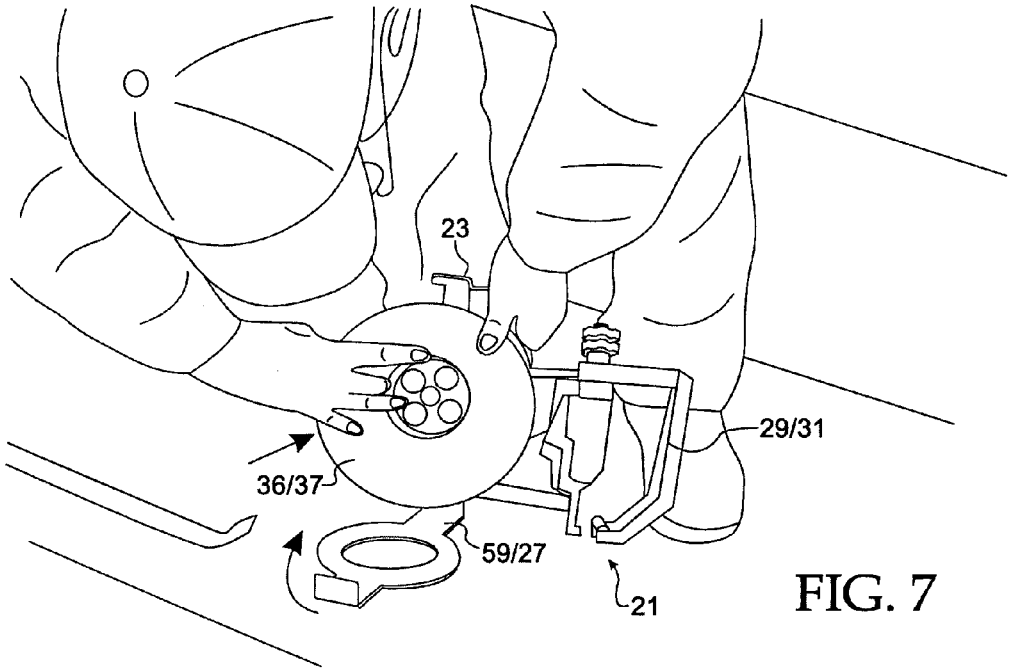
Figure 8:
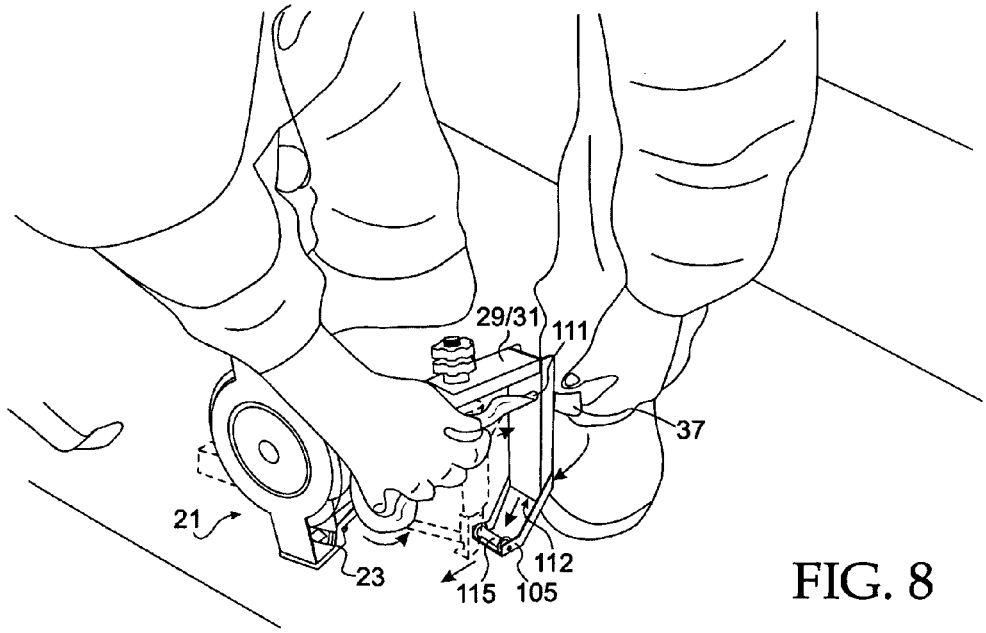
Figure 9:
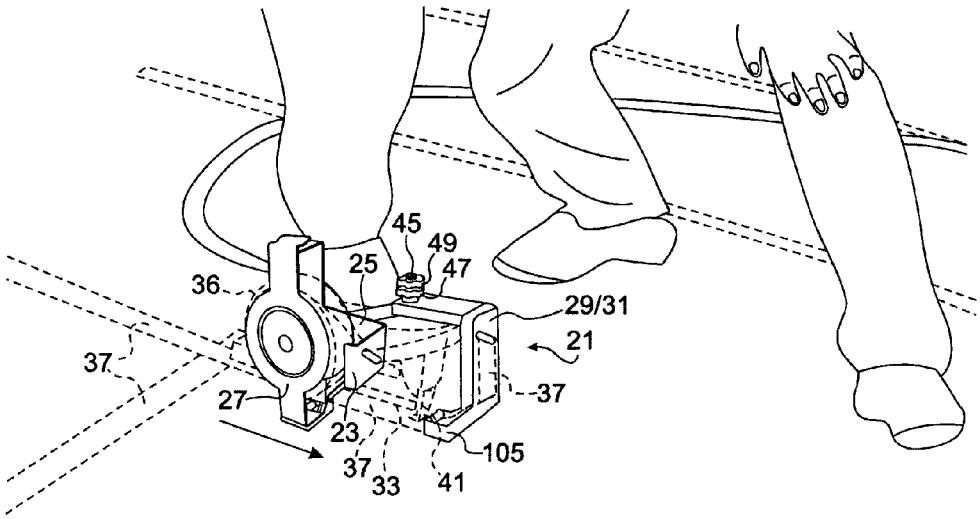

Turning to FIGS. 6 through 9, use of apparatus 21 commences when a user assembles the apparatus by mounting pivot stud 39 on driver 33 and positions driver 33 in mount body 23 with structure 25 receiving and securing driver 33 and integrated fastener supply 35 as described above (FIG. 6). Gate 59 is opened and coiled supply 36 of material 37 is mounted at structure 27 of mount body 23 (FIG. 7) and material 37 is fed through feed slots 98 and 111, junction slot 112 and between guide roller 117 and locator chute 115 (FIG. 8). The user then guides apparatus 21 and operates fastener driver 33 in a conventional fashion, adjusting material presentation direction as required by conditions by loosening knobs 47/49 on post 45 and pivoting arm 31 to the selected angle when necessary, retightening the knobs when properly located (FIG. 9).

In this manner, the user may pivot outflow locator 105 about drive head 41 of driver 33 to selectively change direction of material feed presentation relative to the drive head. Moreover, since mount body 23 preferably receives and secures fastener driver 33, fastener supply 35 and supply 36 of material 37 to be fastened in a fixed relationship to one another at one side of the apparatus while orientation arm 31 controlling direction of material feed to fastener driver head 41 is located at an opposite side of the apparatus, a well balanced and easy to handle assemblage is provided for a user.

Figure 10:
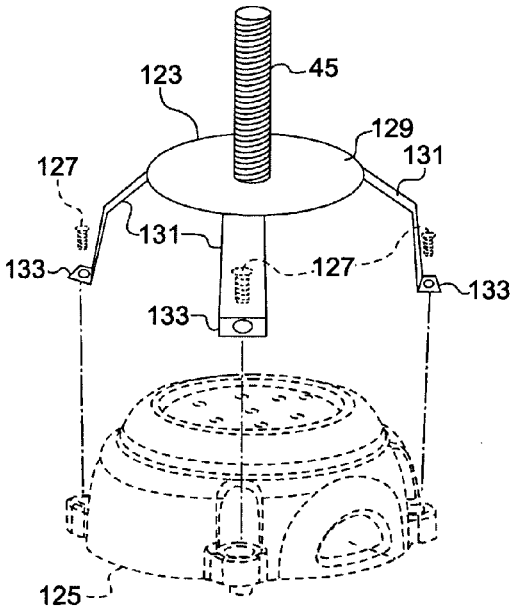
FIG. 10 is a perspective view of another type of pivot stud utilizable with the apparatus of this invention.
Figure 11:
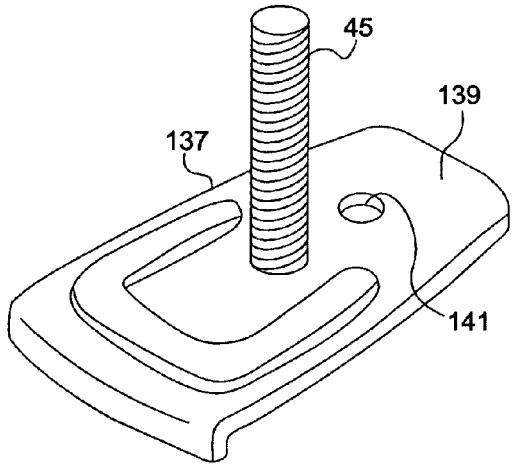
FIG. 11 is a perspective view of yet another type of pivot stud utilizable with the apparatus of this invention.

Turning now to FIGS. 10 and 11, differently configured pivot studs of the apparatus of this invention, utilizable with different drivers (nailers in these cases), are shown. Both include integrated post 45 for interface with mount body 23 and orientation arm 31 as described hereinabove. Stud 123 of FIG. 10 is mounted over end cap 125 of a nailer/driver utilizing the cap's own mounting screws 127. Post 45 is affixed to mounting plate 129 having mounting appendages 131 extending therefrom at an angle appropriate to clear the cap structure. Screws 127 are received through openings in mount tabs 133 at the ends of appendages 131. Another type stud 137 shown in FIG. 11 replaces a different type of existing end cap of a nailer/driver. Post 45 is affixed to replacement plate-type cap 139 which is held on the driver utilizing a mounting screw threw opening 141. All remaining securement knobs and washers as described above may thus be utilized with these studs.

Figure 12:
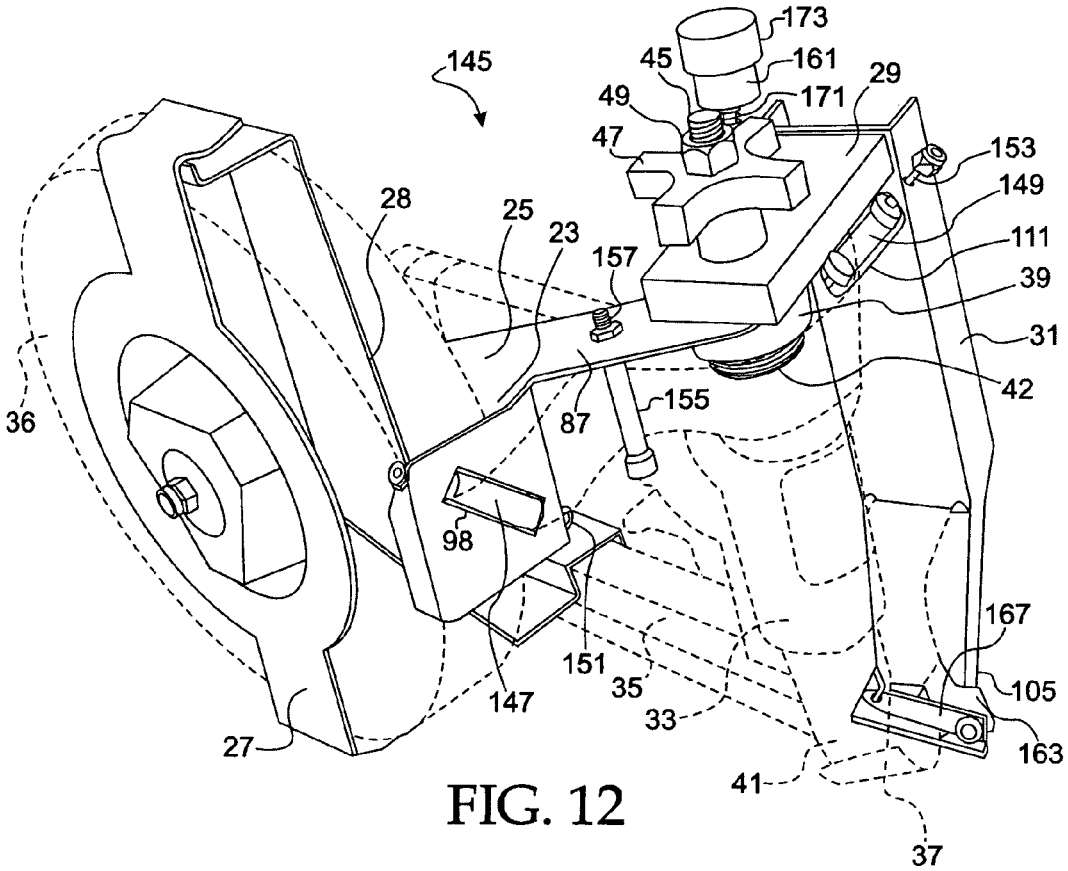
FIG. 12 is a perspective view of a second embodiment of the mount and feed guide apparatus of this invention.
Figure 13:
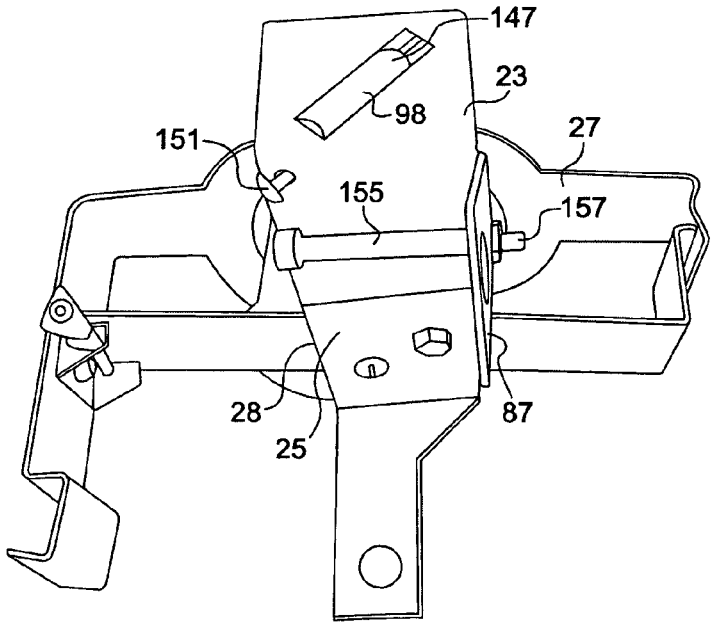
FIG. 13 is a perspective view the driver/material supply mount body of the apparatus of FIG. 12.
Figure 14:
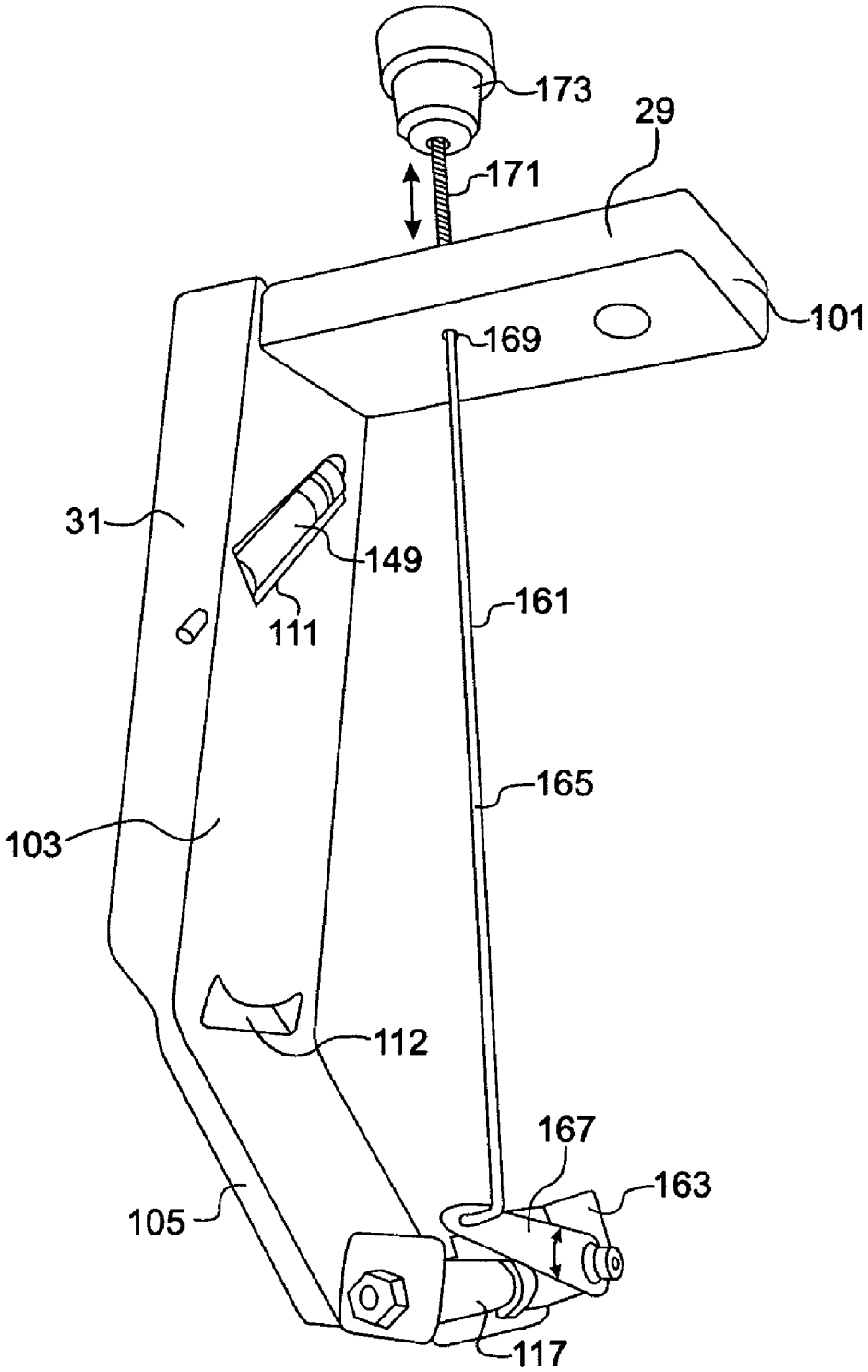
FIG. 14 is a perspective view of the feed orientation arm of the apparatus of FIG. 12.

A second embodiment 145 of the apparatus of this invention is illustrated in FIGS. 12 through 14. Only those features additional to those described above will be referred to herein, numbers identifying substantially similar features as heretofore described being retained in these FIGURES where necessary to the description. Apparatus 145 includes guide rollers 147 and 149 at slots 98 and 111, respectively, the rollers maintained on axle assemblies 151 and 153, respectively. Intermediate guide roller 155 is mounted on axle assembly 157 extending from flange 87 to guide material 37 closer to driver 33. Material cutter assembly 161 is mounted through openings at headstock 101 and flange 163 at outflow locator 105 adjacent to guide roller 117. Cutter assembly 161 includes actuator rod 165 engaging one end of cutter blade 167 at distal rod end and receivable through opening 169 in headstock 101 at the other rod end. The opposite end of cutter blade 167 is pivotable mounted at flange 163. Biasing spring 171 is maintained on rod 165 between actuator knob 173 and headstock 101, biasing blade 167 to an open position. When a user depresses knob 173 overcoming spring bias, blade 167 is pivoted into engagement with material at the outflow from locator 105, thereby severing the material thereat (see FIG. 14). The blade is returned by spring bias when knob 173 is released.

The apparatus of this invention can be utilized with various installations or systems utilizing coiled material for reinforcing, marking, sealing, securing, trimming or the like wherein material fastening to a work surface is accomplished using a stapler, brad or nail gun. For example, the apparatus may be employed for dry-in systems attaching tarpaper or other underlayments, systems of attachment of foam house sheathing, sucurement systems for protection barriers (utilized for mobile home transport, for example), systems for application of reinforcing material for vapor barriers, lumber protector wrap or securement attachment systems, various installations of reinforcing strips (for example, with appliance or other large item packaging enclosures), house wrap installations, reinforcement installations for temporary construction fencing, installations of perimeter marking strips, installation systems for various rolled tag and marking materials (tapes, tags and strips of various kinds) in use in a variety of industries, pallet banding and marking systems, upholstery and carpet/carpet pad reinforcement strip installations, flexible finish and/or trim installations, and/or window, door, and other weather stripping systems.

What is claimed is:

1. A mount and feed guide apparatus adapted for use with a supply of material to be fastened at a work surface and a related fastener driver having a drive head, said apparatus comprising:

a mount body adapted to receive and secure the fastener driver thereat;

a material feed orientation arm pivotably connected with said mount body at a first end thereof, a material outflow locator provided at a second end thereof, said orientation arm configured so that said outflow locator is adjacent to the drive head and the work surface when said apparatus is in use and is pivotable about the drive head to selectively change direction of material feed presentation relative to the drive head, said mount body and said orientation arm configured to accommodate relative pivotable movement through an arc of up to about 240°; and a material supply carrier positioned to receive the supply of material and provide material to said orientation arm.

2. The apparatus of claim 1 further comprising a pivot stud adapted for connection to the fastener driver over the drive head, said mount body including a pivot mount for receipt of said pivot stud thereat and positioned so that in use said pivot stud and the drive head of the fastener driver define an axis substantially normal to the work surface, and said first end of said feed orientation arm rotatably maintained at said pivot stud.

3. The apparatus of claim 1 wherein said feed orientation arm includes an outflow channel adjacent to said outflow locator.

4. The apparatus of claim 1 wherein said material supply carrier is configured at said mount body so that, in use, the supply of material and the fastener driver are held in a fixed relationship to one another.

5. The apparatus of claim 1 wherein the supply of material is strip material provided in a coil, said material supply carrier including a rotational mount to accommodate decoiling of the material as it is provided to said orientation arm.

6. The apparatus of claim 1 wherein said mount body includes a material feed redirector at one part thereof for changing direction of material fed from said supply carrier toward said feed orientation arm.

7. The apparatus of claim 1 wherein said feed orientation arm includes a material feed redirector at one part thereof for receipt of material fed from said supply carrier and directing the material toward said outflow locator.

8. The apparatus of claim 1 wherein said outflow locator includes a guide roller.

9. A mount and feed guide apparatus for selectively locating material from a coiled supply at a work surface for fastening thereat utilizing a powered fastener driver having a drive head and a reloadable fastener supply associated therewith, said apparatus comprising:

a mount body having a first structure adapted to receive and secure the fastener driver and fastener supply thereat and a second structure at one side of the first structure for rotational receipt of the coiled supply of material, the fastener driver, fastener supply and coiled supply of material thereby mounted and held in a substantially fixed relationship to one another;

a pivot stud affixable to the fastener driver over the drive head thereof and receivable at said first structure of said mount body; and a material feed orientation arm receiving said pivot stud at a first end thereof to pivotably locate said orientation arm at an opposite side of said first structure of said mount body from said second structure, a material outflow locator provided at a second end of said orientation arm, said orientation arm configured so that said outflow locator is adjacent to the drive head and the work surface when said apparatus is in use, said outflow locator pivotable about the drive head to selectively change direction of material feed presentation relative to the drive head.

10. The apparatus of claim 9 wherein said orientation arm includes an outflow channel adjacent to said outflow locator and a first angled material feed redirecting slot adjacent to said first end for receipt of material fed from said second structure of said mount body and directing the material to said outflow channel.

11. The apparatus of claim 10 wherein said second structure of said mount body includes a coiled material receiver and a second angled material feed redirecting slot for changing direction of material fed from said receiver toward said first angled material feed redirecting slot of said orientation arm.

12. The apparatus of claim 11 further comprising guide rollers at said angled feed redirecting slots.

13. The apparatus of claim 9 wherein said second structure of said mount body includes a releasable gate accommodating loading and rotational securement of the coiled supply of material at said second structure, and wherein said first structure includes plural driver mounting flanges.

14. The apparatus of claim 9 further comprising a guide roller having spaced guide wheels at said outflow locator.

15. The apparatus of claim 9 wherein said feed orientation arm includes a material cutter thereat having a cutter actuator adjacent to said first end of said orientation arm and a cutting blade adjacent to said second end thereof.

16. A method for selectively orienting feed direction from a coiled supply of strip material to a fastener driver head for fastening of the material at a work surface comprising the steps of:

locating the coiled supply of material and the driver head in a fixed relationship to one another for selected manual movement by a user across the work surface;

feeding the material from the supply of material to a material outflow structure pivotable about the driver head;

establishing material feed direction at the work surface relative to the driver head by pivoting the structure on an axis defined substantially normal to the work surface through the driver head; and selectively varying the feed direction as needed by a user during material fastening at the work surface.

17. The method of claim 16 further comprising the step of cutting the material adjacent to the driver head after fastening of a selected length of the material at the work surface.

18. The method of claim 16 wherein the step of establishing material feed direction by pivoting the structure includes selective location through an arc of up to about 240° relative to the driver head.

19. The method of claim 16 wherein the step of locating the coiled supply of material and the driver head includes locating the supply of material at one side of the driver head.

20. The method of claim 19 further comprising the step of locating the outflow structure at a side of the driver head opposite the one side.

* * * * *